US006719042B2

(12) United States Patent
Johnson et al.

(10) Patent No.: US 6,719,042 B2
(45) Date of Patent: Apr. 13, 2004

(54) SHEAR RAM ASSEMBLY

(75) Inventors: Christopher D. Johnson, Cypress, TX (US); Tri Canh Le, Spring, TX (US); George W. Tisdale, Spring, TX (US); Esteban Palomo, Jr., Houston, TX (US)

(73) Assignee: Varco Shaffer, Inc., Houston, TX (US)

( * ) Notice: Subject to any disclaimer, the term of this patent is extended or adjusted under 35 U.S.C. 154(b) by 32 days.

(21) Appl. No.: 10/191,258

(22) Filed: Jul. 8, 2002

(65) Prior Publication Data

US 2004/0003919 A1 Jan. 8, 2004

(51) Int. Cl.[7] ..... E21B 29/08
(52) U.S. Cl. ..... 166/55; 166/297; 277/129
(58) Field of Search ..... 166/55, 55.3, 55.6, 166/55.8, 297, 298, 323; 277/129; 251/1.1, 1.3

(56) References Cited

U.S. PATENT DOCUMENTS

| | | | | |
|---|---|---|---|---|
| 3,561,526 A | | 2/1971 | Williams et al. | |
| 3,736,982 A | | 6/1973 | Vujasinovic | |
| 4,240,503 A | | 12/1980 | Holt et al. | |
| 4,341,264 A | | 7/1982 | Cox et al. | |
| 4,347,898 A | | 9/1982 | Jones | |
| 4,537,250 A | | 8/1985 | Troxell | |
| 4,540,046 A | | 9/1985 | Granger et al. | |
| 4,646,825 A | | 3/1987 | Van Winkle | |
| 5,360,061 A | | 11/1994 | Womble | |
| 5,400,857 A | | 3/1995 | Whitby et al. | |
| 5,515,916 A | | 5/1996 | Haley | |
| 5,713,581 A | | 2/1998 | Carlson et al. | |
| 5,906,375 A | | 5/1999 | Young et al. | |
| 6,158,505 A | * | 12/2000 | Araujo | 166/55 |

* cited by examiner

*Primary Examiner*—Frank Tsay
(74) *Attorney, Agent, or Firm*—Loren G. Helmreich; Browning Bushman, P.C.

(57) ABSTRACT

The shear ram assembly 10 for shearing an oil well tubular T includes a first ram 16 axially moveable along the first axis 66 for moving an upper blade 17, and an opposing second ram 18 axially moveable along the second ram axis 68 for moving a lower blade 19. An upper planar surface 40 of the lower blade passes closely adjacent a lower planar surface 42 of the upper blade as the blades move towards each other to shear the tubular. The sealing system 24 is positioned within a recess 26 in the upper surface of the lower blade, and includes an elastomeric seal 28 for sealing engagement with the lower planar surface of the upper blade and a rigid actuator 30 moveable relative to the lower blade to energize the elastomeric seal.

20 Claims, 3 Drawing Sheets

SHEAR RAM ASSEMBLY

FIELD OF THE INVENTION

The present invention relates to ram assemblies of the type used in the oil and gas industry and, more particularly, to a shear ram assembly which provides more reliable sealing between an upper blade and a lower blade.

BACKGROUND OF THE INVENTION

Ram assemblies referred to as blowout preventers ("BOPs") are commonly used in the oil and gas industry while exploring for and extracting hydrocarbons, such as oil and gas. One or more commonly two ram assemblies are used in series to cut off the flow from the well in an emergency. Some ram assemblies are intended to seal off an annulus surrounding a tubular, while other ram assemblies have the ability to both severe the tubular and seal in the well. Blades fixed to opposing shear rams may thus be driven together to completely shear the tubular. The lower portion of the severed tubular typically remains in the well beneath the shear rams, and the upper severed portion may be removed. The cut edge of the upper and lower tubular portions are sometimes referred to, respectively, as the upper and lower "fish," and "fishing tools" are used to retrieve the lower fish. A sealing element acting between the upper and lower shear blades or between each blade and the shear ram housing prevent fluid from escaping through the closed shear ram assembly.

Blade configurations and corresponding sealing elements for shear ram assemblies are numerous in the prior art. One general type of seal may be described as a face seal, in which a face or a leading edge of one or both rams comes to rest forcefully against a seal element after shearing. U.S. Pat. No. 3,561,526 describes a shear ram assembly which is intended to reduce the likelihood of damage to the sealing elements as a result of the shearing process. After the two rams sever the tubular, the rams continue to slide past one another until each ram presses against an opposing seal element. This creates two vertically spaced pressure seals, with a greater combined likelihood of reliable sealing than might be possible with just one seal.

In other shear rams, the sealing element is instead carried in the sliding face of the upper blade to seal between the blades after shearing. Although the cutting edge of the blade passes over the sealing element, which can damage the seal, this arrangement is preferred for many applications since the seal does not depend on a known final position for the blades. Numerous patents propose minimizing the risk of seal damage with this type of shear ram assembly. U.S. Pat. No. 4,540,046 is one example of a shear ram assembly comprising a seal actuator which actuates the seal into compressive engagement with the opposing blade only after the cutting edge of the blade has passed over the seal. U.S. Pat. No. 5,713,581 discloses a seal configuration designed to resist the damaging rollover of the seal element that may occur when one blade slides over the seal element. U.S. Pat. No. 4,347,898 discloses a shear ram assembly intended to withstand high forces tending to separate the blades without damage to the seal. U.S. Pat. No. 5,515,916 discloses shear rams in which a cross seal strip on one blade face is constructed and arranged to avoid being damaged by the other blade. Avoiding damage to the sealing element is clearly a fundamental concern for shear ram assemblies that seal between the blades.

Prior art shear ram assemblies thus include a seal element carried in the lower face of the upper blade. U.S. Pat. Nos. 4,540,046, 5,713,581, and 4,537,250 are examples of this type of configuration. One reason for this preference is the lower surface of the upper blade and thus the seal element is protected by the upper blade from dirt and debris. Furthermore, fluid pressure from the well beneath the rams helps energize the seal in those assemblies having an actuator bar, since fluid pressure from below acts on the actuator bar to further activate the seal.

In addition to protecting the sealing element, another primary concern associated with shear ram assemblies is the time and expense involved with maintenance. Millions of dollars are routinely spent in the operation of a wellhead, and downtime results in loss of revenues and profitability. The oil and gas industry is therefore interested in equipment that is less expensive and time consuming to operate. U.S. Pat. No. 5,360,061 discloses shearing rams which shear a tubing string in such a manner that a separate trip may not be required to prepare the upper fish left in the well bore prior to lowering an overshot to engage the upper end of the sheared tubing string. U.S. Pat. No. 5,400,857 discloses a shear ram assembly intended to minimize equipment costs and operating expenses. Other patents of interest include U.S. Pat. Nos. 4,341,264, 4,240,503, and 5,906,375.

The present invention surpasses the prior art, offering a shear ram assembly with an improved sealing system. The sealing system avoids the drawbacks of the prior art, particularly for those shear ram assemblies having a sealing element between the sliding blades.

SUMMARY OF THE INVENTION

The present invention relates to improvements in a shear ram assembly, which is commonly part of a BOP which contains an upper shear ram assembly and a lower pipe ram assembly. The tool joint of the oilfield tubular is conventionally hung off on the lower pipe rams once the upper shear ram assembly is actuated to shear the tubular. More particularly, the present invention relates to improvements in the location of the sealing system which seals between an upper shear blade and a lower shear blade of the shear ram assembly.

The shear ram assembly may thus be actuated to shear a tubular extending into a well and seal fluid pressure within the well. The assembly comprises a first ram axially moveable along a first axis for moving an upper blade, and an opposing second ram axially moveable along a second axis for moving a lower blade, with the first and second axes preferably being substantially coaxial and perpendicular to a centerline of the shear ram assembly, which coincides with a centerline of the tubular being sheared. The upper blade and the lower blade are each slidably moveable toward the centerline of the tubular, and at least one and optionally both of the upper blade and the lower blade include a shearing edge for shearing the tubular. An upper planar surface of the lower blade thus passes closely below a lower planar surface of the upper blade as the blades move toward each other in response to actuation of the first and second rams to shear the tubular. The sealing system is positioned substantially within a recess in the upper surface of the lower blade, and includes an elastomeric seal for sealing engagement with the lower planar surface of the upper blade and a rigid actuator moveable relative to the lower blade to energize the elastomeric seal.

In a preferred embodiment, the actuator includes an energization ramp for engagement with the upper blade as the blades move toward each other, such that the upper blade urges the actuator downward to compress the elastomeric seal, thereby energizing the elastomeric seal. The actuator preferably comprises an elongate actuator bar having a bar axis generally perpendicular to the centerline of the shear ram assembly. A retainer bar supported on the lower blade overlaps a portion of the actuator bar to restrict upward movement of the actuator bar.

It is an object of the present invention to provide an improved shear ram assembly wherein the sealing system is positioned substantially within a recess in the upper surface of the lower blade, such that the top edge of a lower fish does not contact and damage the elastomeric seal when the shear ram assembly is subsequently opened, thereby extending the useful life of the sealing system compared to a shear ram assembly wherein the elastomeric seal is provided in a lower surface of the upper blade.

It is a feature of the present invention that the lower surface of the upper blade may be hardened, preferably by a laser hardening process, to resist damage by the sheared tubular after the shearing operation, specifically when the shear ram assembly is opened.

A further feature of the invention is that the sealing system includes a leading anti-extrusion insert and a trailing anti-extrusion insert each adjacent an upper surface of the elastomeric seal to prevent pressurized extrusion of the elastomeric seal into a gap between the upper surface of the lower blade and the lower surface of the upper blade.

A related feature of the invention is that the upper blade includes a leading edge surface sloping upward from the lower surface of the upper blade to an upper blade edge for initially engaging the sealing system, thereby minimizing the likelihood of the upper blades damaging the sealing system.

These and further objects, features, and advantages of the present invention will become apparent from the following detailed description, wherein reference is made to the figures and the accompanying drawings.

DETAILED DESCRIPTION OF PREFERRED EMBODIMENTS

Figure 1:
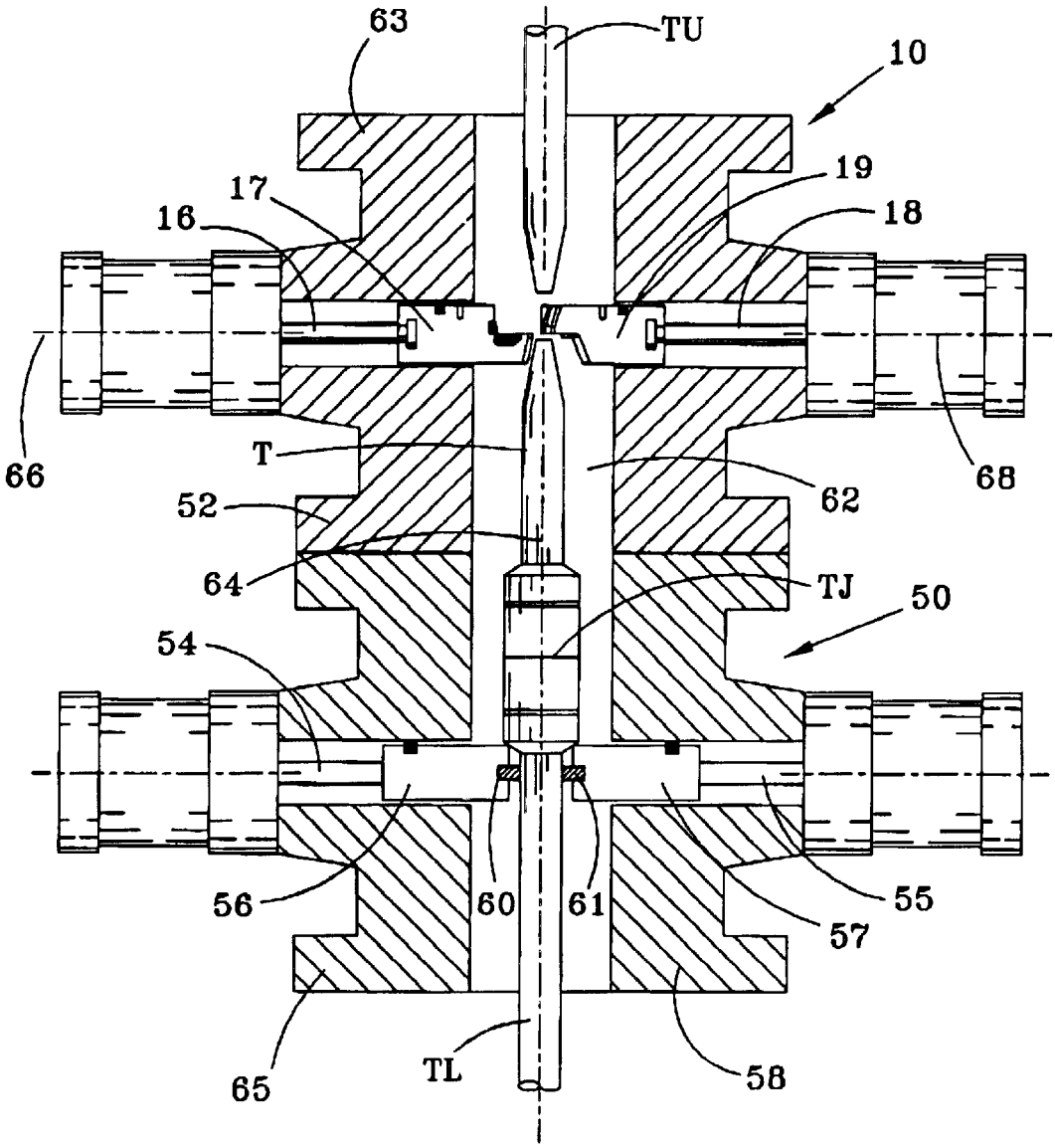
FIG. 1 shows an upper shear ram assembly having sheared a tubular, with pipe rams positioned below the shear rams.

FIG. 1 shows an overall view of the shear ram assembly 10 having sheared on oilfield tubular T. The shear ram assembly 10 is positioned above a pipe ram assembly 50 and each assembly 10, 50 or the combination of 10 and 50 may be referred to as a blowout preventer or BOP. The tubular is conventionally positioned within a wellbore for pumping fluids into a well and/or for transmitting hydrocarbons from the well to the surface. The tubular T is thus positioned within an upper shear ram body or housing 52 sized for receiving the tubular T, while a similar lower body 58 supports the pipe rams. A pair of opposing pipe rams 54, 55 move respective pipe sealing rams 56, 57 within the lower pipe ram body 58. Each of the pipe rams 56, 57 includes a ram seal 60, 61 for sealing engagement with the tubular T, thereby closing off the annulus around the tubular. As shown in FIG. 1, the tubular includes a tool joint TJ having a diameter greater than the nominal diameter of the tubular T, so that when the tubular T is sheared the tool joint is "hung off" on the closed lower pipe rams 56, 57.

The body portions or housings 52, 58 may be formed separately or may be formed as an integral body, and conventionally include an upper flange 63 and a lower flange 65 for sealing engagement with related wellhead equipment (not shown). Each body 52, 58 defines generally vertical throughbore 62 which defines a centerline of the shear ram assembly. Each of the rams 16, 18, 54, 55 moves a respective shearing ram or sealing ram axially toward the centerline 64 of the shear ram assembly, which coincides with the centerline of the tubular T. Both the shear rams 16,18 are actuated simultaneously, as are the sealing rams 54, 55, so that the rams substantially simultaneously engage the tubular T. Shearing blade 17 is thus moved by a ram 16 along the axis 66, while shear blade 19 is moved by shear ram 18 along axis 68. The axes 66, 68 are preferably coaxial, and each axis is preferably substantially perpendicular to the centerline 64 of the shear ram assembly.

Referring again to the shear ram assembly 10, the first shear ram 16 carries an upper blade 17, and a second shear ram 18 carries a lower blade 19. The upper and lower shear rams 16,18 are hydraulically actuated for moving the upper and lower blades 17,19 toward each other, such as during an emergency, to sever the tubular T and seal fluid pressure within the wellhead system. The pipe rams 56, 57 are positioned below the shear rams 16,18 for capturing and supporting the lower portion of the tubular T upon shearing.

Figure 2:
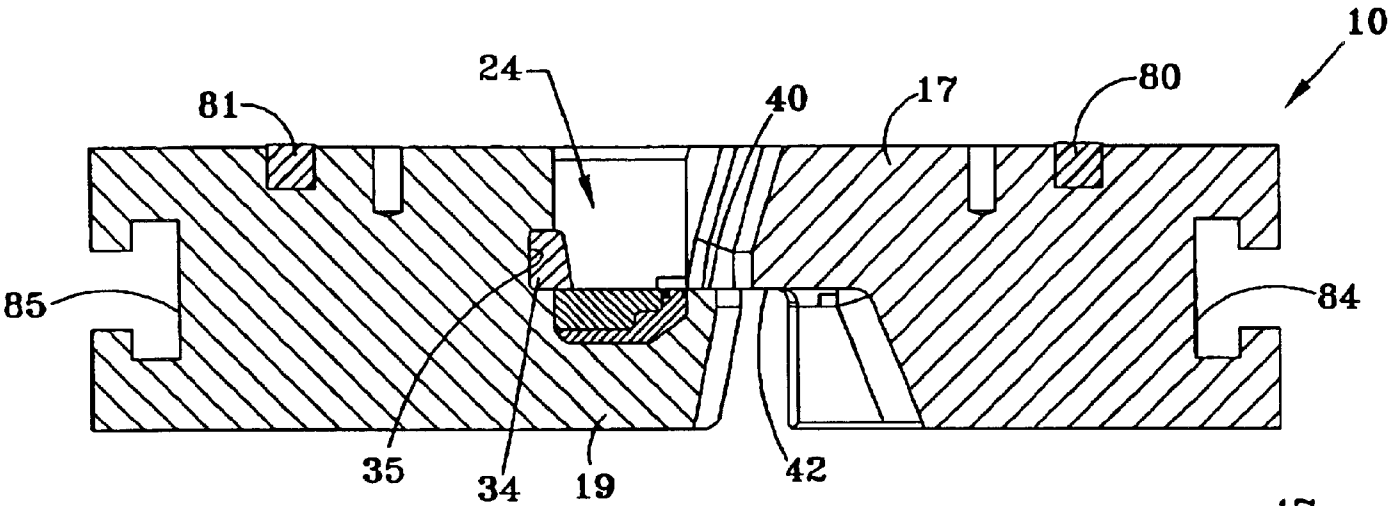
FIG. 2 shows the blades of the shear ram assembly moved toward each other, without a tubular inserted, in a partially overlapping position.
Figure 2A:
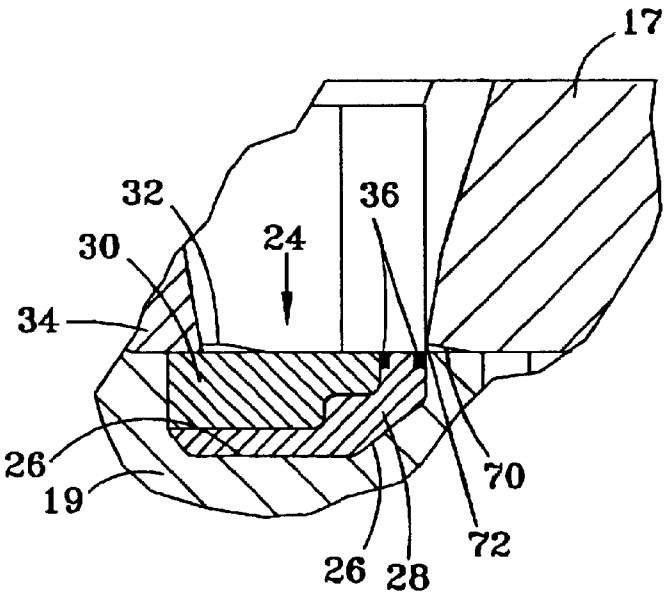
FIG. 2A shows a closeup view of the sealing system shown in FIG. 2.
Figure 3:
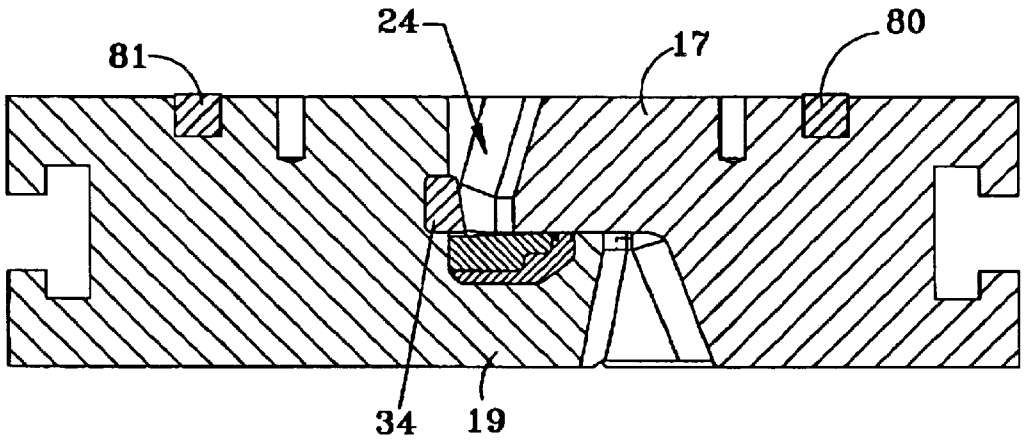
FIG. 3 shows the shear ram assembly without a tubular in a fully closed and sealed position.

FIG. 2 shows the upper and lower blades 17,19 slightly overlapping, but not fully and sealingly closed. The shear blade conventionally has a V-shaped shear edge, so that the shear blades center the tubular within the blade prior to cutting. The leading surfaces on the side of the shear blades are shown in FIGS. 2 and 3. The cutouts 84 and 85 at the outward end of each shear blade are sized to mate with a similarly configured end of each shear ram. In this position, the tubular T would be partially or fully severed. FIG. 2A is an enlarged view of the sealing system 24 positioned substantially within a recess 26 in the upper face 40 of the lower blade 19. An elastomeric seal 28 within the recess 26 has an exposed upper surface 29 for sealing engagement with the lower face 42 of the upper blade 17. An actuator 30, which preferably is a rigid elongated member in the form of a bar having a bar axis substantially perpendicular to the ram axis 66, is in engagement with and partially covers the elastomeric seal 28, and is included with the sealing system 24 for energizing the elastomeric seal 28. Prior to full closure of the shear ram assembly 10, the elastomeric seal 28, including the exposed portion 29, is preferably at or slightly below the upper face 40 of the lower blade 19 to avoid damage from the upper blade 17. As the blades 17,19 continue to move together beyond the position shown in FIGS. 2 and 2A, a portion of the lower surface 42 of the upper blade 19 will pass over and seal with the exposed upper surface 29 of the elastomeric seal 28. Each shear blade 17, 19 conventionally includes an upper seal 80, 81 for sealing between the respective blade and the body 56.

Figure 3A:
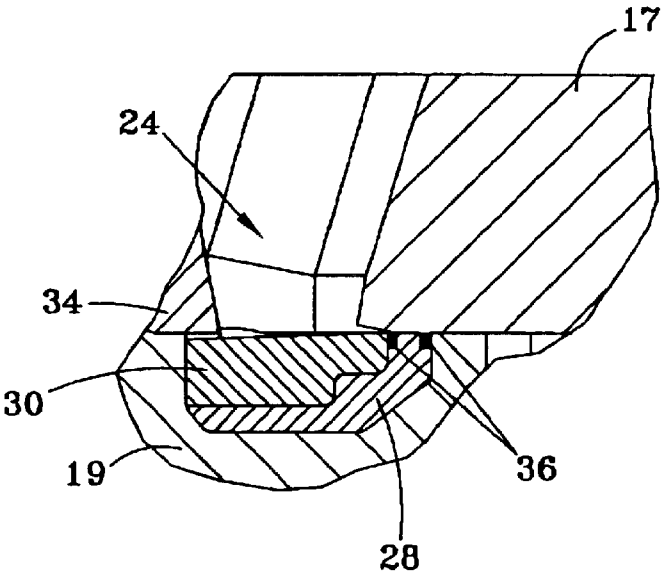
FIG. 3A shows a closeup view of the sealing system with the blades in the fully closed and sealed position.

FIG. 3 shows the shear ram assembly 10 in a fully closed position FIG. 3A is an enlarged view of the sealing system 24 shown in FIG. 3. As the blades 17,19 move from the FIG. 2 position to the closed position as shown in FIG. 3, the upper blade 17 engages an energization ramp 32 on the actuator bar 30. Engagement of the energization ramp 32 urges the actuator bar 30 downwardly to displace upwardly a portion of the elastomeric seal 28 which includes the sealing surface 29. The surface 29 thus sealingly engages the lower surface 42 of the upper blade 17 to seal fluid pressure within the wellhead system. The ramp 32 need not extend along the exterior length of the actuator bar, and a pair of ramps near the ends of the actuator bar may serve the desired purpose. A retainer bar 34 is preferably included to cooperate with the sealing system 24, and is supported in a recess 35 in the lower blade 19, as shown in FIG. 2. The retainer bar 34 constrains a portion of the actuator bar 30, restricting upward movement of the actuator bar 30 which would otherwise occur during energization of the elastomeric seal 28.

A pair of anti-extrusion inserts 36 are preferably included in the sealing system 24 adjacent the exposed portion 29 of the elastomeric seal 28. Energization of the elastomeric seal 28 may result in high forces which might otherwise extrude the elastomeric seal 28 between any gaps between the lower surface 42 of the upper blade 17 and the upper surface 40 of the lower blade 18. The anti-extrusion inserts 36 block the elastomeric seal 28 from entering these gaps. The anti-extrusion inserts 36 may be made of a hard rubber, a relatively soft metal, such as brass, or other material that would resist extrusion of the elastomeric seal under high fluid pressure.

Ideally, the actuator bar 30 would be positioned at or below the upper surface 40 of the lower blade 19 prior to closing the shear ram assembly 10. As a practical matter, however, the actuator bar 30 might be elevated slightly, whether due to temperature changes, errors in manufacturing, normal wear and tear, or other causes. If the actuator bar 30 is positioned above the upper surface 40 of the lower blade 19, the upper blade 17 might hang on the actuator bar 30, possibly damaging components of the shear ram assembly 10. To prevent such hanging and ensure reliable operation of the shear ram assembly 10, an upwardly sloping surface 70 of the upper blade 17 between the lower surface 42 and the edge 72 may be provided to first contact the actuator bar 30 as the blades 17,19 move toward each other. The angle of this ram surface 70 is exaggerated in FIGS. 2A and 3A for clarity. The upwardly sloping surface 70 would urge the actuator bar 30 back down so the upper blade 17 could pass over it without damage. Thus upwardly sloping surface of the upper blade 17 could be, for example, a chamfer or beveled surface.

FIG. 1 shows the shear ram assembly 10 in the closed position after shearing the tubular T. The severed tubular T results in an upper tubular TU having an upper fish, and a lower tubular TL having a lower fish. The "fish" are the potentially sharp, severed edges of the upper and lower tubulars. The pipe rams as shown in FIG. 1 clamp onto the lower tubular TL to hold it in place. The upper tubular TU is conventionally removed prior to re-opening the shear ram assembly 10. Upon re-opening the shear ram assembly, it is not uncommon for the lower fish to remain in dangerous proximity to the lower surface 42 of the upper blade 17. This often damages the sealing system on prior art shear ram assemblies, which carry the sealing system on the lower surface of the upper blade. In the present invention, the sealing system 24 is protected from the lower fish by virtue of its location on the upper surface 40 of the lower blade 19.

To a lesser extent, the lower fish may pose a risk of damage to the lower surface 42 of the upper blade 17. This lower surface 42 is typically made of metal, however, and is much less prone to damage than are the components of the sealing system 24. In the preferred embodiment, this lower surface 42 may be treated to increase its hardness to minimize risk of damage. The lower surface 24 may be laser-hardened, for example, so that the heating by a laser hardens the surface. Alternatively, the lower surface 24 may comprise a hardened insert whose hardness and durability exceeds that of the upper blade 17 in which it is housed.

In the preferred embodiment, the components of the sealing system 24 are accessible without significant disassembly of the shear ram assembly 10. By virtue of their location in the upper surface 40 of the lower ram 19, the components of the sealing system 24 may be accessed more easily for inspection, repair, or replacement. Furthermore, the components of the sealing system 24 may be removable easily and with conventional tools.

It may be appreciated that changes to the details of the illustrated embodiments and systems disclosed are possible without departing from the spirit of the invention. While preferred and alternative embodiments of the present invention have been described and illustrated in detail, it is apparent that further modifications and adaptations of the preferred and alternative embodiments may occur to those skilled in the art. However, it is to be expressly understood that such modifications and adaptations are within the spirit and scope of the present invention, set forth in the following claims.

What is claimed is:

1. A shear ram assembly for shearing a tubular in a well and sealing fluid pressure within the well, the shear ram assembly comprising:

a shear ram housing having a throughbore defining a centerline for the shear ram assembly and for receiving the tubular;

a first ram axially moveable with respect to the housing along a first axis for moving an upper blade;

an opposing second ram axially moveable with respect to the housing along a second axis for moving a lower blade, the upper blade and lower blade each slidably movable toward a centerline of the shear ram assembly in response to activation of the first ram and the second ram;

at least one of the upper blade and the lower blade having a shearing edge for shearing the tubular, an upper planar surface of the lower blade passing below a lower planar surface of the upper blade as the blades move toward each other to shear the tubular; and a sealing system positioned substantially within a recess in the upper surface of the lower blade, the sealing system including an elastomeric seal for sealing engagement with the lower planar surface of the upper blade and a rigid actuator moveable relative to the lower blade to energize the elastomeric seal.

2. A shear ram assembly as defined in claim 1, wherein the actuator includes an energization ramp for engagement with the upper blade as the blades move toward each other, such that the upper blade urges the actuator downward to compress the elastomeric seal.

3. A shear ram assembly as defined in claim 2, further comprising:

the actuator comprises an elongate actuator bar having a bar axis generally perpendicular to the centerline of the shear ram assembly; and a retainer bar supported on the lower blade and overlapping a portion of the actuator bar to restrict upward movement of the actuator bar.

4. A shear ram assembly as defined in claim 1, wherein the sealing system further comprises a leading anti-extrusion insert and a trailing anti-extrusion insert each adjacent an upper surface of the elastomeric seal to prevent pressurized extrusion of the elastomeric seal into a gap between the upper surface of the lower blade and the lower surface of the upper blade.

5. The shear ram assembly as defined in claim 1, wherein the upper blade includes a leading edge surface sloping upwardly from the lower surface of the upper blade to an upper blade edge for initially engaging the sealing system.

6. A shear ram assembly as defined in claim 1, wherein the lower surface of the upper blade is hardened to resist damage by the sheared tubular.

7. A shear ram assembly as defined in claim 6, wherein the lower surface of the upper blade is laser-hardened.

8. A shear ram assembly for shearing a tubular in a well and sealing fluid pressure within the well, the shear ram assembly comprising:

a first ram axially moveable along a first axis for moving an upper blade;

an opposing second ram axially moveable along a second axis for moving a lower blade, the upper blade and lower blade each slidably movable toward a centerline of the shear ram assembly in response to activation of the first ram and the second ram;

at least one of the upper blade and the lower blade having a shearing edge for shearing the tubular, an upper planar surface of the lower blade passing closely below a lower planar surface of the upper blade as the blades move toward each other to shear the tubular; and a sealing system positioned substantially within a recess in the upper surface of the lower blade, the sealing system including an elastomeric seal for sealing engagement with the lower planar surface of the upper blade and a rigid actuator bar having an axis generally perpendicular to a centerline of the shear ram assembly and moveable relative to the lower blade to energize the elastomeric seal.

9. A shear ram assembly as defined in claim 8, wherein the actuator bar includes an energization ramp for engagement with the upper blade as the blades move toward each other, such that the upper blade urges the actuator bar downward to compress the elastomeric seal.

10. A shear ram assembly as defined in claim 8, wherein the sealing system further comprises a leading anti-extrusion insert and a trailing anti-extrusion insert each adjacent an upper surface of the elastomeric seal to prevent pressurized extrusion of the elastomeric seal into a gap between the upper surface of the lower blade and the lower surface of the upper blade.

11. The shear ram assembly as defined in claim 8, wherein the upper blade includes a leading edge surface sloping upwardly from the lower surface of the upper blade to an upper blade edge for initially engaging the sealing system.

12. A shear ram assembly as defined in claim 8, wherein the lower surface of the upper blade is hardened to resist damage by the sheared tubular.

13. A shear ram assembly as defined in claim 12, wherein the lower surface of the upper blade is laser-hardened.

14. A shear ram assembly for shearing a tubular in a well and sealing fluid pressure within the well, the shear ram assembly comprising:

a shear ram housing having a throughbore defining a centerline for the shear ram assembly and for receiving the tubular;

a first ram axially moveable with respect to the housing along a first axis for moving an upper blade;

an opposing second ram axially moveable along a second axis for moving a lower blade, the upper blade and lower blade each slidably movable toward a centerline of the shear ram assembly in response to activation of the first ram and the second ram;

at least one of the upper blade and the lower blade having a shearing edge for shearing the tubular, an upper planar surface of the lower blade passing closely below a lower planar surface of the upper blade as the blades move toward each other to shear the tubular; and a sealing system positioned substantially within a recess in the upper surface of the lower blade, the sealing system including an elastomeric seal for sealing engagement with the lower planar surface of the upper blade and a rigid actuator bar having an axis generally perpendicular to the centerline of the ram assembly and moveable relative to the lower blade to energize the elastomeric seal; and an energization ramp for engagement with the upper blade as the blades move toward each other, such that the upper blade engages the energization ramp to urge the actuator bar downward to compress the elastomeric seal.

15. A shear ram assembly as defined in claim 14, further comprising:

a retainer bar supported on the lower blade and overlapping a portion of the actuator bar to restrict upward movement of the actuator bar.

16. A shear ram assembly as defined in claim 14, wherein the sealing system further comprises a leading anti-extrusion insert and a trailing anti-extrusion insert each adjacent an upper surface of the elastomeric seal to prevent pressurized extrusion of the elastomeric seal into a gap between the upper surface of the lower blade and the lower surface of the upper blade.

17. The shear ram assembly as defined in claim 14, wherein the upper blade includes a leading edge surface sloping upwardly from the lower surface of the upper blade to an upper blade edge for initially engaging the sealing system.

18. A shear ram assembly as defined in claim 14, wherein the lower surface of the upper blade is hardened to resist damage by the sheared tubular.

19. A shear ram assembly as defined in claim 18, wherein the lower surface of the upper blade is laser-hardened.

20. A shear ram assembly as defined in claim 14, further comprising:

a lower pipe ram assembly including opposing rams for urging sealing rams into sealing engagement with the tubular.

* * * * *